US005389123A

United States Patent [19]

Bronson

[11] Patent Number: 5,389,123

[45] Date of Patent: Feb. 14, 1995

[54] METHOD FOR CONTINUOUSLY RECOVERING METALS USING A DUAL ZONE CHEMICAL REACTOR

[75] Inventor: Mark C. Bronson, Livermore, Calif.

[73] Assignee: The United States of America as represented by the United States Department of Energy, Washington, D.C.

[21] Appl. No.: 87,549

[22] Filed: Jul. 8, 1993

[51] Int. Cl.[6] ..... C22B 59/00; C22B 60/00

[52] U.S. Cl. ..... 75/393; 75/414; 75/610

[58] Field of Search ..... 423/3, 5, 21.1; 75/393, 75/395, 397, 399, 414, 610

[56] References Cited

U.S. PATENT DOCUMENTS

| | | | |
|---|---|---|---|
| 712,161 | 10/1902 | Vosburgh | 423/129 |
| 2,176,242 | 10/1939 | Bowes | 423/149 |
| 3,023,089 | 2/1962 | Graves, Jr. et al. | 422/193 |
| 3,625,657 | 12/1971 | Mathis et al. | 423/132 |
| 3,779,711 | 12/1973 | Gryaznov et al. | 422/149 |
| 4,205,046 | 5/1980 | Popovici | 422/193 |
| 4,482,524 | 11/1984 | Hardison | 422/170 |
| 4,929,430 | 5/1990 | Otomura et al. | 423/11 |
| 5,118,343 | 6/1992 | Coops | 75/396 |
| 5,141,723 | 8/1992 | Miller et al. | 423/5 |
| 5,160,367 | 11/1992 | Pierce et al. | 75/397 |
| 5,202,100 | 4/1993 | Nagel et al. | 423/5 |

*Primary Examiner*—Ngoclan T. Mai

*Attorney, Agent, or Firm*—Henry Sartorio; Roger S. Gaither; William R. Moser

[57] ABSTRACT

A dual zone chemical reactor continuously processes metal-containing materials while regenerating and circulating a liquid carrier. The starting materials are fed into a first reaction zone of a vessel containing a molten salt carrier. The starting materials react to form a metal product and a by-product that dissolves in the molten salt that flows to a second reaction zone in the reaction vessel. The second reaction zone is partitioned from, but in fluid communication with, the first reaction zone. The liquid carrier continuously circulates along a pathway between the first reaction zone and the second reaction zone. A reactive gas is introduced into the second reaction zone to react with the reaction by-product to generate the molten salt. The metal product, the gaseous waste products, and the excess liquid carrier are removed without interrupting the operation of the reactor. The design of the dual zone reactor can be adapted to combine a plurality of liquid carrier regeneration zones in a multiple dual zone chemical reactor for production scale processing.

13 Claims, 6 Drawing Sheets

METHOD FOR CONTINUOUSLY RECOVERING METALS USING A DUAL ZONE CHEMICAL REACTOR

The United States Government has rights in this invention pursuant to Contract No. W-7405-ENG-48 between the United States Department of Energy and the University of California for the operation of Lawrence Livermore National Laboratory.

FIELD OF THE INVENTION

The present invention relates to the continuous processing of metal-containing compounds in a single, dual zone reactor that contains a recycling, regenerated liquid carrier. The reactor continuously recovers metals from a feedstock of metal oxides or salts.

BACKGROUND OF THE INVENTION

A variety of processing technologies are available for recovering metals or metal compounds from raw or unrefined materials. These treatments typically involve several successive reactions that are best performed under different chemical conditions. Two or more separate reactors are often used, or a single reactor running the reactions sequentially. The individual reactions are batch operations, and the entire process would be improved if all of the reactions were run continuously in the same reactor.

A common example of a metal recovery operation is the reduction of uranium oxide for the production of uranium metal. Metallic uranium is used in uranium enrichment facilities and in the reprocessing of light water reactor fuel. The recycling of spent nuclear fuel minimizes the amount of high level nuclear waste that must be stored. The present invention is applicable in nuclear fuel technology for reprocessing high level radioactive waste and supplying feed material for uranium enrichment facilities.

The reduction of uranium oxide to uranium metal is performed by several methods: oxide and chloride electrolysis, chloride metallothermic reduction, saltless direct oxide reduction, and uranium fluorination with bomb reduction. Currently, the conventional method for producing uranium metal is by the reduction of uranium fluoride, which is obtained from hydrofluorination of uranium oxide. Uranium fluoride is reacted with a reducing metal, such as calcium, in a sealed bomb to produce the free metal and a halide by-product.

This bomb reduction method for producing uranium metal generates large amounts of uranium-containing waste salts that are hazardous and that present waste handling problems. The hydrogen fluoride used in the fluorination of uranium oxide is an extremely corrosive gas that presents environmental and occupational hazards. The direct reduction of metal oxides with calcium in solvent chloride salts also creates large volumes of salt residues that are difficult to process due to the corrosive nature of chloride solutions.

The development of a continuous uranium oxide reduction system that avoids the use of hydrogen fluoride will increase the safety for operating personnel, will decrease the amount of hazardous waste produced, and will be more economical than the current technologies. The present invention reduces metal-containing compounds in a molten salt carrier and produces metals with minimum formation of hazardous waste material. The invention achieves in situ regeneration of the liquid salt phase and full recycling of the liquid carrier within a single dual zone reactor to allow continuous processing of metal-containing compounds.

SUMMARY OF THE INVENTION

The present invention is an apparatus and a process for continuously recovering a metal product from metal-containing compounds in a dual zone chemical reactor. The reactor contains a liquid carrier that circulates between two different chemical environments within the reactor. In particular, the invention can continuously reduce metal oxides to metal while regenerating in situ a molten salt carrier. This continuous oxide reduction system incorporates direct oxide reduction technology, salt regeneration, and continuous product removal technology into a single unit.

Metal reduction typically takes place in a first reaction zone in a reaction vessel containing a molten calcium chloride carrier. The metal oxide is added to the reactor with calcium metal, which reduces the metal oxide to the pure metal and forms calcium oxide. The resulting calcium oxide is solvated in the calcium chloride salt carrier. To maintain continuous operation, the calcium oxide is converted to a calcium chloride carrier by reaction with a chlorinated gas in a second reaction zone of the reactor. The metal product, gaseous waste products, and excess calcium chloride carrier are continually removed from the reactor, and excess carrier can be separated into calcium metal and chloride gas for use as reactants. The dual zone reactor significantly enhances the production rate of metals from oxide feeds with significant reduction in process waste.

This invention will particularly benefit actinide metal operations by significantly increasing throughput and minimizing space in high hazard facilities. A single dual zone reactor can replace several unit operations and will produce significantly less waste than current processes. The high-throughput, continuous operation will replace operator intensive batch operations since the continuous design can be automated, and thereby decrease or eliminate operator radiation exposure.

DETAILED DESCRIPTION OF THE INVENTION

The method and apparatus of the present invention are designed to continuously carry out two chemical processes involving a metal-containing feedstock in a liquid carrier in different reaction zones within a single reaction vessel. The invention incorporates technologies that have been demonstrated as separate steps and combines them into a single reactor. The chemical processes that can be performed in the reactor include oxidation-reduction reactions for recovering metals from metal salts and metal oxides.

I. Metal Oxide Reduction System

Figure 1:
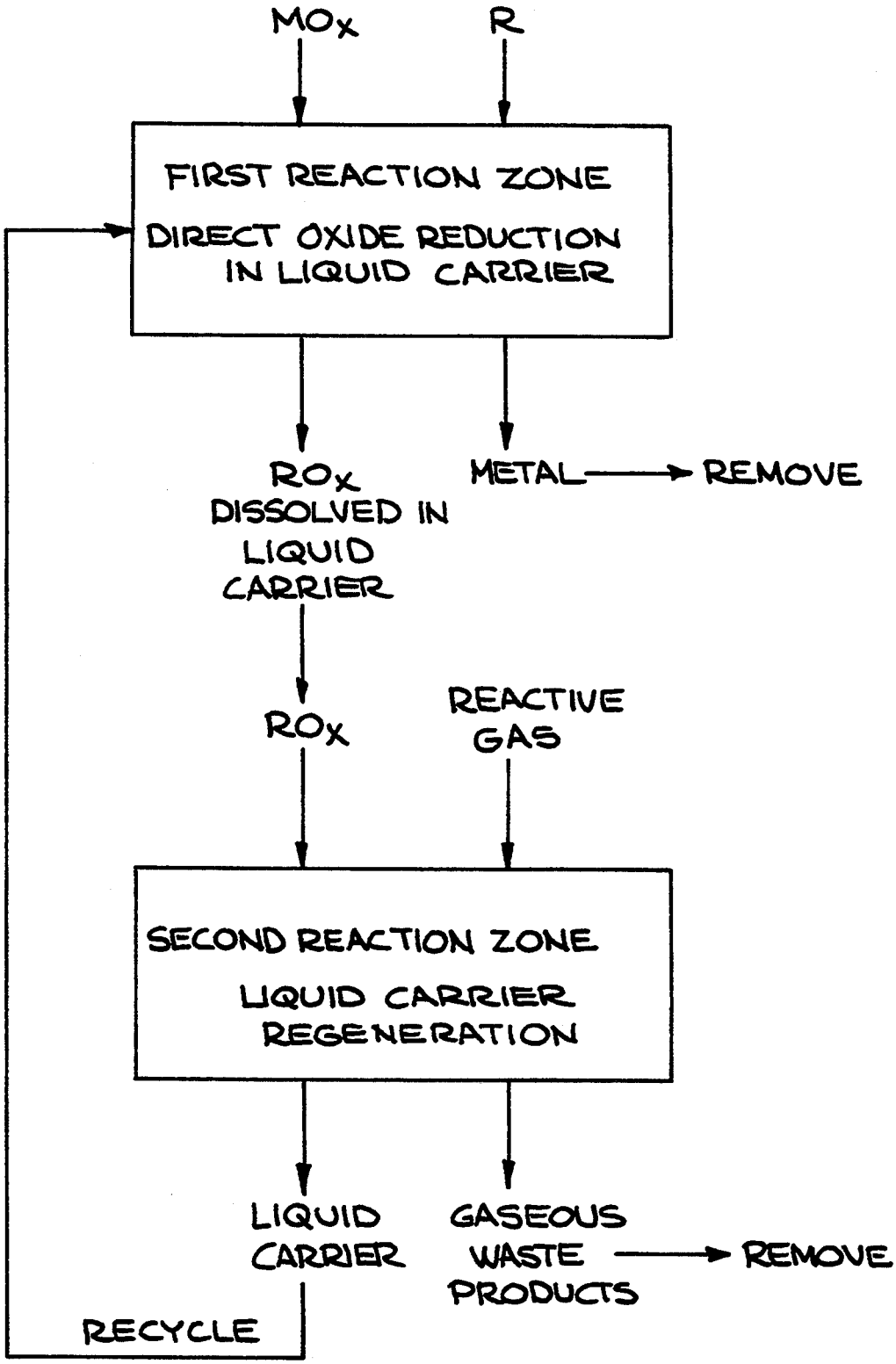
FIG. 1. A flowchart of a continuous metal oxide reduction process with in situ liquid carrier regeneration.
Figure 2:
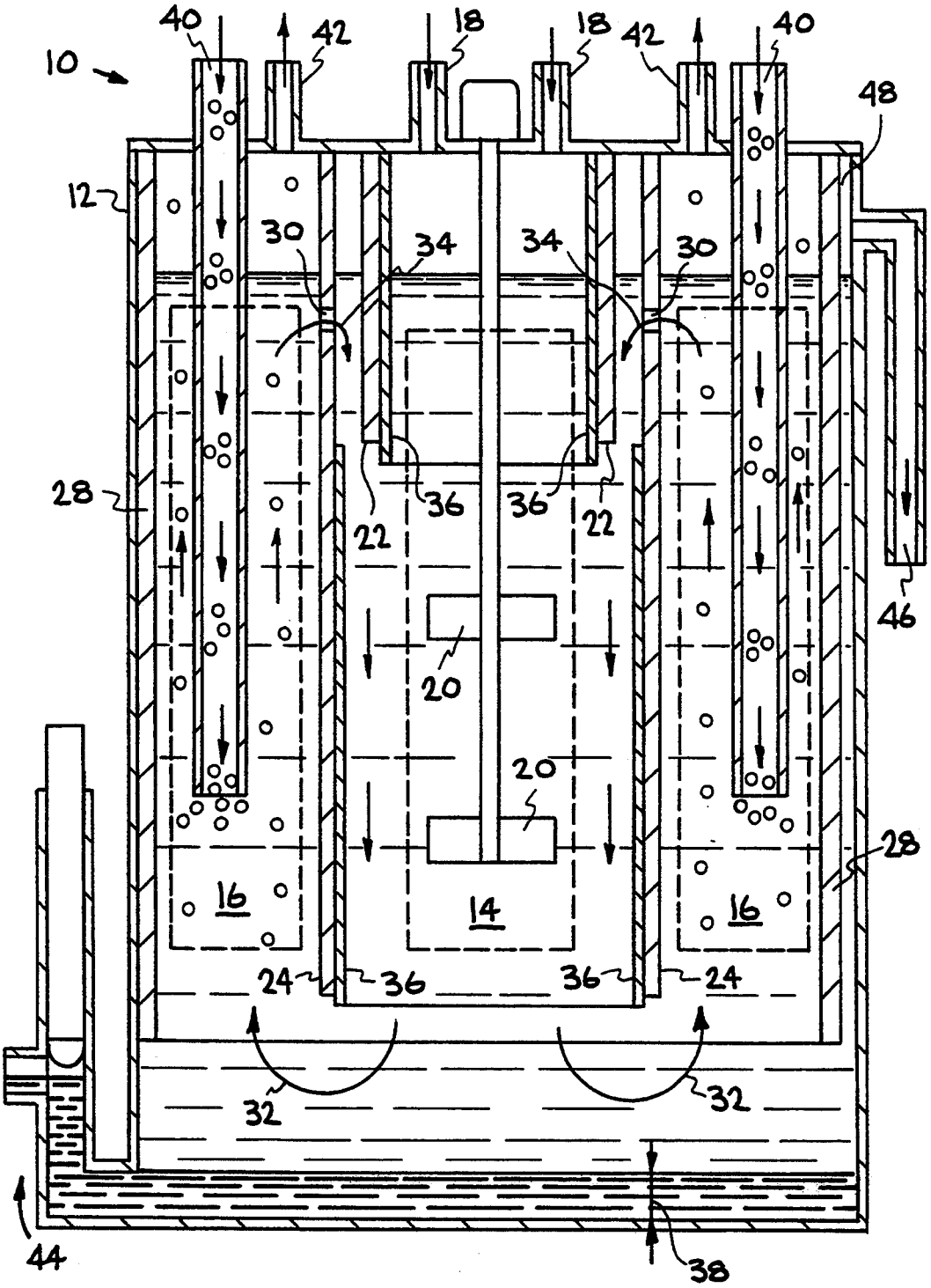
FIG. 2. A dual zone chemical reactor with concentric reaction zones.
Figure 4:
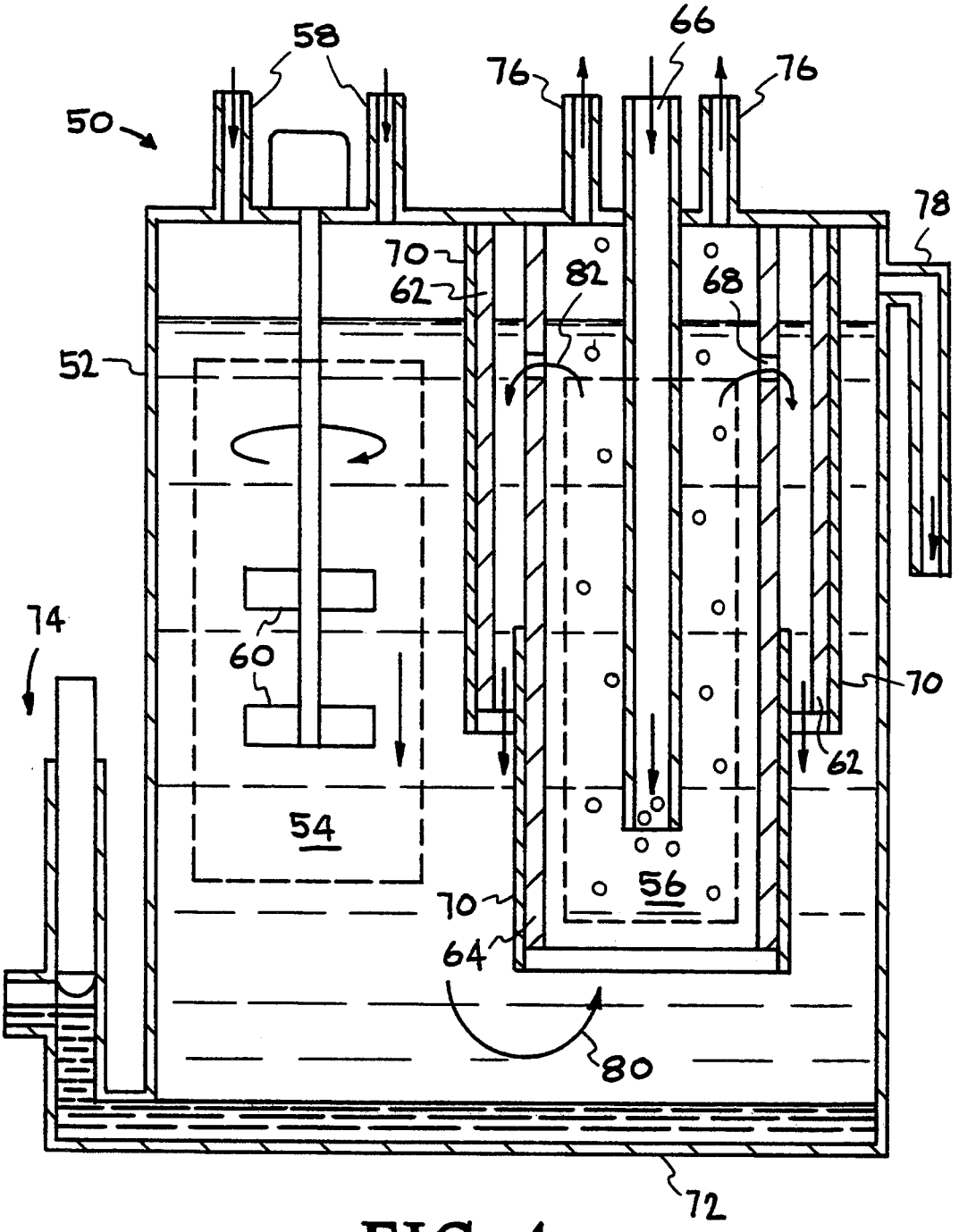
FIG. 4. A dual zone reactor with side-by-side reaction zones.
Figure 6:
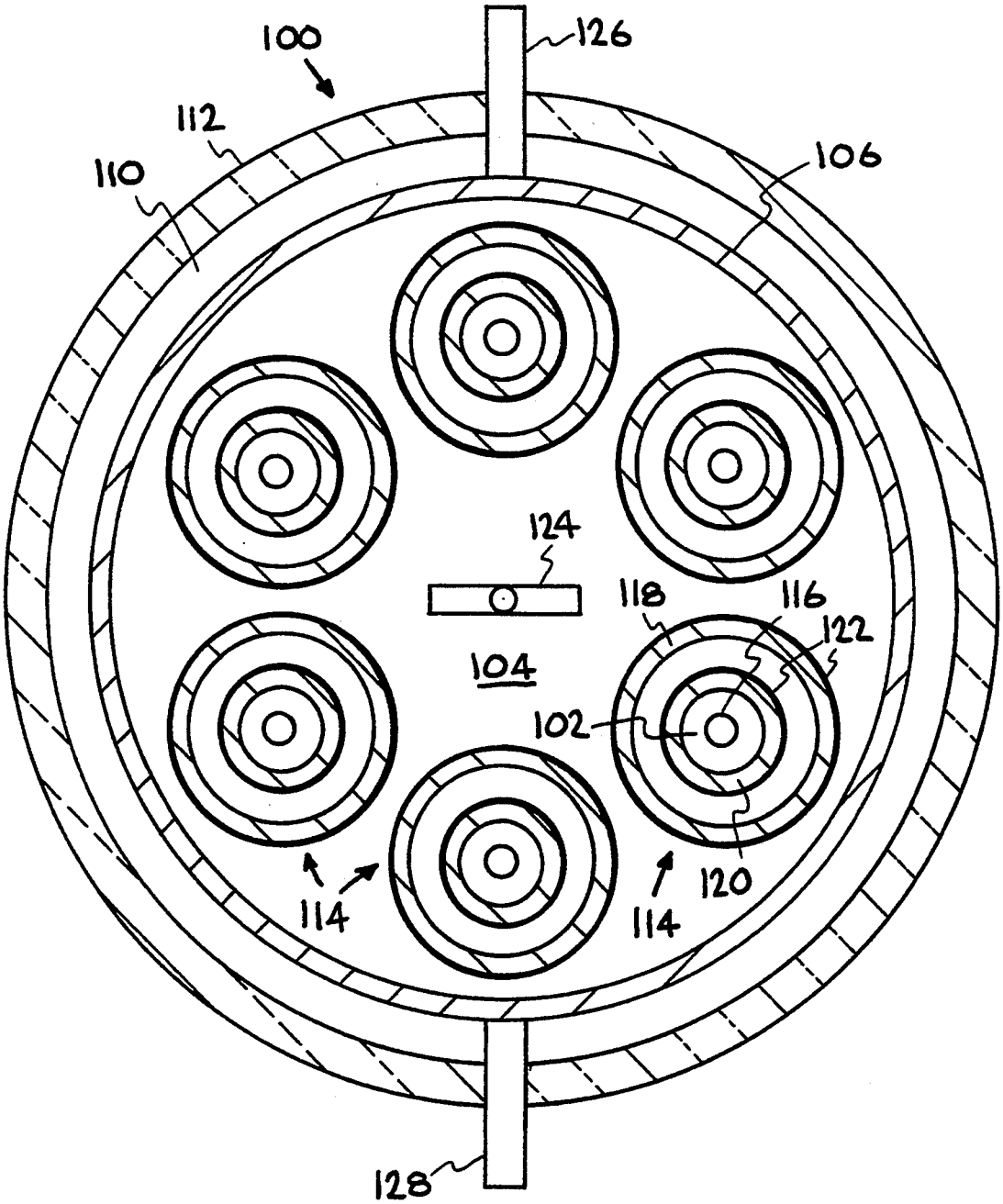
FIG. 6. A top view of a multiple dual zone chemical reactor.

The present invention provides continuous metal oxide reduction with salt regeneration within a single reactor. The metal oxide is reduced in a liquid salt carrier in the first reaction zone, and the salt carrier is regenerated in the second reaction zone from a by-product of the reduction reaction. The regenerated salt carrier is immediately recycled into the first reaction zone for reuse. The metal product, the gaseous waste products, and the excess salt carrier are continually removed from the reaction vessel. FIG. 1 is a flowchart showing the sequence of steps carried out in the two reaction zones in a dual zone reactor; FIGS. 2, 4, and 6 show embodiments of the reactor.

A. Direct Oxide Reduction

Referring to FIG. 1, a solid metal oxide ($MO_x$) and a reducing agent (R) are introduced into the first reaction zone of the reactor. The reactor contains a liquid carrier, which is typically a molten salt, chosen for its high solubility of oxide by-product ($RO_x$). The metal (M) is reduced in the first reaction zone and removed; the metal product may be denser than the liquid carrier and sink to the bottom of the reaction vessel for collection. The reducing agent (R) is oxidized and converted to an oxide by-product ($RO_x$).

The metal oxide ($MO_x$) can be formed of any metal: alkali metals (Group IA), alkaline earth metals (Group IIA), transition metals, rare earth metals (elements 57–72), actinides, and semiconductor elements. Of particular interest for processing are cerium, neodymium, uranium, and plutonium. The reducing agent (R) is typically an alkaline earth metal such as calcium, or an alkali metal. A typical reduction reaction uses calcium as the reducing agent (R) and plutonium or uranium as the metal (M):

$$MO_x + xCa \rightarrow xCaO + M.$$

B. Dissolution

The oxide by-product ($RO_x$) produced in the first reaction zone dissolves in the liquid carrier. The liquid carrier is preferably a halide salt of an alkaline earth metal or an alkali metal. In the uranium example, the calcium oxide (CaO) by-product is typically dissolved in a molten calcium chloride ($CaCl_2$) carrier. The calcium oxide-calcium chloride combination is preferred because calcium oxide is soluble in molten calcium chloride and readily chlorinates to regenerate calcium chloride carrier.

The temperature of the molten salt depends on the composition of the salt carrier and the liquid metal being recovered. Obviously, the temperature of the molten salt must be kept above the melting temperatures of both the salt and the metal product. The metal product may have a much higher melting point than the liquid carrier, as with uranium and calcium chloride. In that case, the metal product collection area may be heated, perhaps by induction, to keep the metal flowing in the collection area, while the liquid carrier is kept at a lower temperature in the reaction zones.

C. Salt Regeneration

The solvated oxide by-product ($RO_x$) reacts with a reactive gas in the second reaction zone of the reaction vessel. The reactive gas is typically a halide and is introduced into the vessel via a pachuca tube. Examples of the halogenated reactive gas include chlorine ($Cl_2$), fluorine ($F_2$), bromine ($Br_2$), hydrogen chloride (HCl), hydrogen fluoride (HF), carbon tetrachloride ($CCl_4$), and phosgene ($COCl_2$). In a reaction vessel where the reactive gas comprises hydrogen chloride or chlorine, the chlorination reactions in the second reaction zone regenerate the salt carrier ($CaCl_2$) and produce a gaseous waste product of water ($H_2O$) or oxygen ($O_2$):

$$CaO + 2HCl \rightarrow H_2O + CaCl_2; \text{ or}$$
$$2CaO + Cl_2 \rightarrow CaCl_2 + O_2.$$

The regenerated liquid carrier ($CaCl_2$) is recycled into the first reaction zone for reuse in the continuing metal oxide reduction.

D. Product and Waste Removal

The gaseous waste products (e.g., $H_2O$, $O_2$) rise and escape the second reaction zone of the reaction vessel. The path of the waste products is designed so that the waste does not contact, or react with, the starting materials or reactants. The liquid carrier is continuously regenerated, and excess liquid carrier is removed. The excess calcium chloride carrier can be purified and processed to recover calcium metal and chloride gas, which then can be used as reactants in the first and second reaction zones of the reactor.

The metal product typically is denser than the liquid carrier and sinks to a collection area, where the product is removed from the vessel. However, the metal product could be less dense than the carrier and separate by rising to the surface of the liquid and floating, whereby the product is collected by skimming the surface of the liquid carrier. Likewise, the waste products could be separated by sinking and removed at the bottom of the vessel. In some cases, the collection of a metal alloy is desirable, and so one or more metal elements are introduced into the first reaction zone of the reactor. The added metal and the metal product can be collected as a molten mixture.

II. Dual Zone Chemical Reactors

Figure 3:
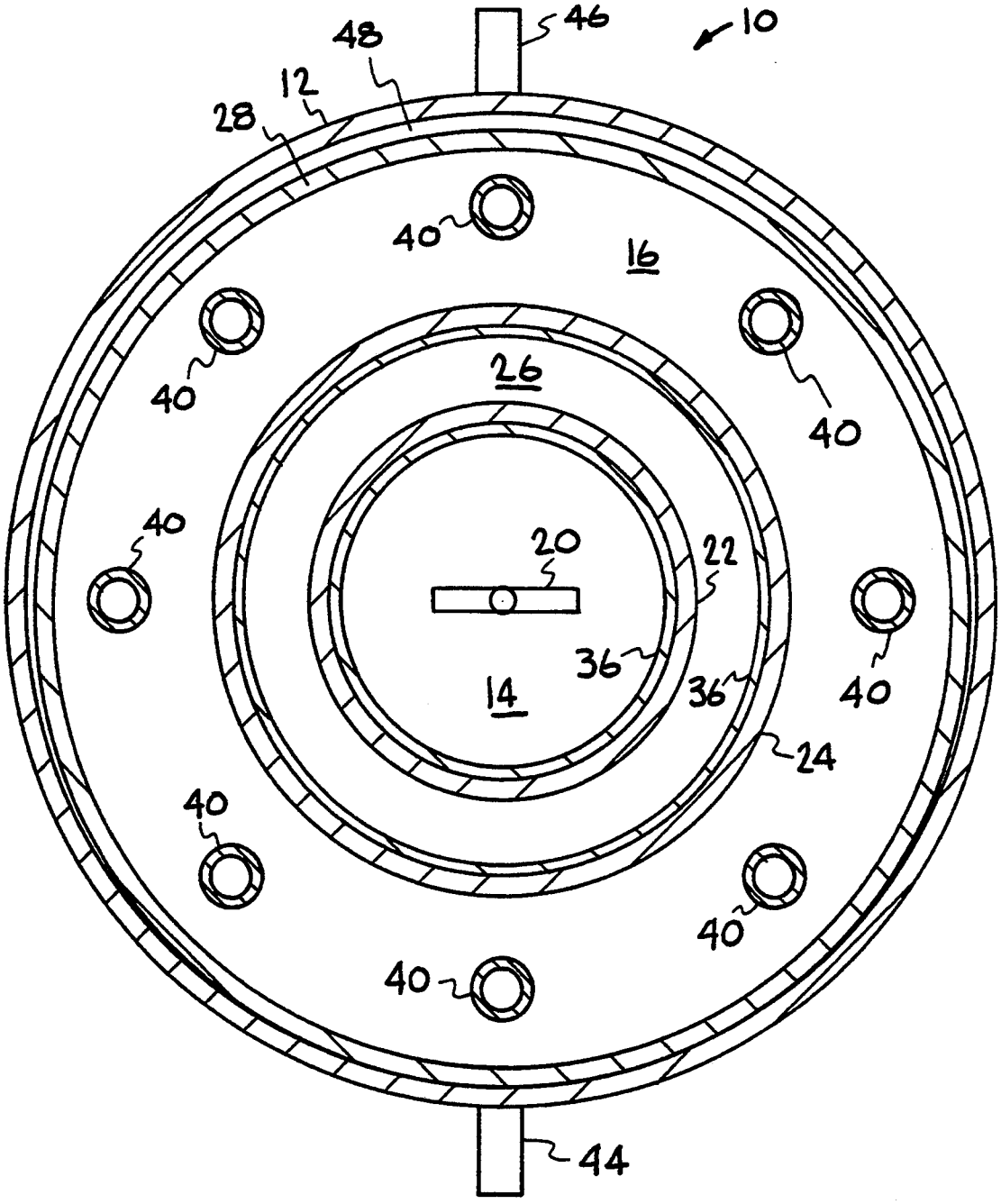
FIG. 3. A top view of the concentric dual zone reactor.

FIG. 2 is a cross-section of a concentric dual zone chemical reactor 10 that is comprised of a reaction vessel 12 containing a liquid carrier. FIG. 3 shows a top view of this reactor 10. A first reaction zone 14 is centrally located in the vessel 12, and a second concentric reaction zone 16 is located around the inside perimeter of the vessel 12. The reaction zones 14,16 are outlined in dotted lines in FIG. 2. The starting materials or reactants are fed through inlet means 18 at the top of the reactor 10 into the liquid carrier in the first reaction zone 14. A circulating means 20, connected to the top of the reactor 10, is provided in the first reaction zone 14 to agitate the liquid carrier and induce dissolution and interaction of the reactants.

Two cylindrical partition walls 22,24 separate the first reaction zone 14 from the second reaction zone 16. The first partition wall 22 is situated between the circulating means 20 and the second partition wall 24. A space 26 separates the first wall 22 from the second wall 24. The second partition wall 24 is situated between the first partition wall 22 and the inner wall 28 of the vessel 12. The partition wails 22,24 are connected to the top of the reactor 10 and are shown having different lengths.

The first wall 22 extends below the surface of the liquid carrier to the midsection of the vessel 12. The second wall 24 extends farther into the liquid carrier, but has holes 30 near the surface of the liquid carrier that allow liquid to pass through the second wall 24. The second partition wall 24 fully separates the first and second reaction zones 14,16.

The partition walls 22,24 do not have to be different lengths. The positioning of the partition walls 22,24 limits and directs the flow of carrier along a pathway from the first reaction zone 14 to the second reaction zone 16, and then back to the first reaction zone 14. The partition walls 22,24 could be of equal length, as long as diffusion holes are provided in the partition walls 22,24 to allow liquid carrier to flow through and be continuously circulated between the first and second reaction zones 14,16. The two reaction zones 14,16 must be separated, but in open flow communication at points where the chemical species in the first reaction zone 14 can meet the reactive gas in the second reaction zone 16, and where the liquid carrier generated in the second reaction zone 16 can be recycled to the first reaction zone 14. The partition walls 22,24 isolate the upward flow of liquid carrier near the inner wall 28 of the vessel 12 and direct the downward flow of regenerated liquid carrier to the first reaction zone 14. The partition walls 22,24 also restrict the flow of gaseous waste to the top of the reactor 10, so as not to react with the feed material entering the reactor 10 at the first reaction zone 14.

The vessel walls 28 and partition walls 22,24 are made of materials that are inert to the liquid carrier and the chemical species contained therein, and can withstand the reactor temperatures. For example, during uranium reduction the reactor reaches temperatures in the range of 700°–1200° C., and therefore the wall materials are typically highly refractory, corrosion-resistant ceramics and metals. The vessel 12 itself is made of a ceramic material or a metal such as tantalum or tungsten. The inner wall of the vessel 28 is typically made of a ceramic such as magnesium oxide (MgO). The partition walls 22,24 also typically comprise magnesium oxide and have an additional layer 36 of tantalum metal facing the first reaction zone 14.

The starting materials react in the first reaction zone 14, producing a by-product and a metal product that is shown in FIG. 2 as denser than the liquid carrier and therefore is removed by sinking to the bottom of the vessel 12 to a product collection area 38. Alternatively, the metal product may float to the surface of the liquid carrier and be drawn off. The liquid carrier and by-product flow past the second partition wall 24 along path 32 to the second reaction zone 16. A gas supply means 40 in the second reaction zone 16 introduces a reactive gas into the liquid carrier near the bottom of the second reaction zone 16, between the second partition wall 24 and the inner wall 28 of the vessel 12. The gas supply means 40 is typically a pachuca tube through which the reactive gas is injected into the liquid carrier.

The reactive gas reacts with the chemical species (i.e., by-product) in the second reaction zone 16 to form a waste gas and to generate the liquid carrier. The gas bubbles rise between the second partition wall 24 and the inner wall 28 of the vessel 12, inducing the flow of liquid carrier to the top of the second reaction zone 16. A current is created between the two reaction zones 14,16, driven by the continuous downward flow of denser starting material in the first reaction zone 14 and the continuous upward flow of the liquid carrier in the second reaction zone 16. The regenerated liquid carrier flows through the holes 30 in the second partition wall 24, along path 34, past the first partition wall 22, and into the first reaction zone 14 for reuse. The apparatus in FIG. 2 could be modified so that the circulation of liquid carrier and the placement of reaction zones are reversed: the downward flow occurs at the sides of the vessel, and the upward flow occurs in the center.

The circulating means 20 is located in the midportion of the first reaction zone 14 and is appreciably above the bottom of the second partition wall 24. The circulating means 20 must be far enough from the bottom of the vessel 12 to allow the dense metal product to separate from the chemical species that react in the second reaction zone 16. This distance between the circulating means 20, the second partition wall 24, and a product collection area 38 prevents the metal product from being stirred up and interfering with the reactions in the second reaction zone 16.

Outlet means 42,44,46 provide pathways to remove the reaction products from the vessel 12. The gaseous waste products (e.g., $O_2$, $H_2O$) escape the liquid carrier and are released through waste outlet means 42 at the top of the reactor 10. The metal products fall through the typically less dense liquid carrier to a collection area 38 and exit through product outlet means 44 located near the bottom of the vessel 12. The product outlet means 44 may be a weir, as shown in FIG. 2. A stream of excess generated liquid carrier can be withdrawn through outlet means 46 to allow uninterrupted operation of the reactor. A space 48 between the vessel 12 and vessel wall 28 permits the excess carrier to flow to the outlet means 46.

Heating means (not shown) on the outside of the vessel 12 typically are used to heat the liquid carrier to the desired temperature. Insulating means (not shown) then surround the vessel 12 and the heating means. A temperature gradient may be created in the vessel 12 to maintain liquid flow of a high-melting point metal product near the collection area 38.

Figure 5:
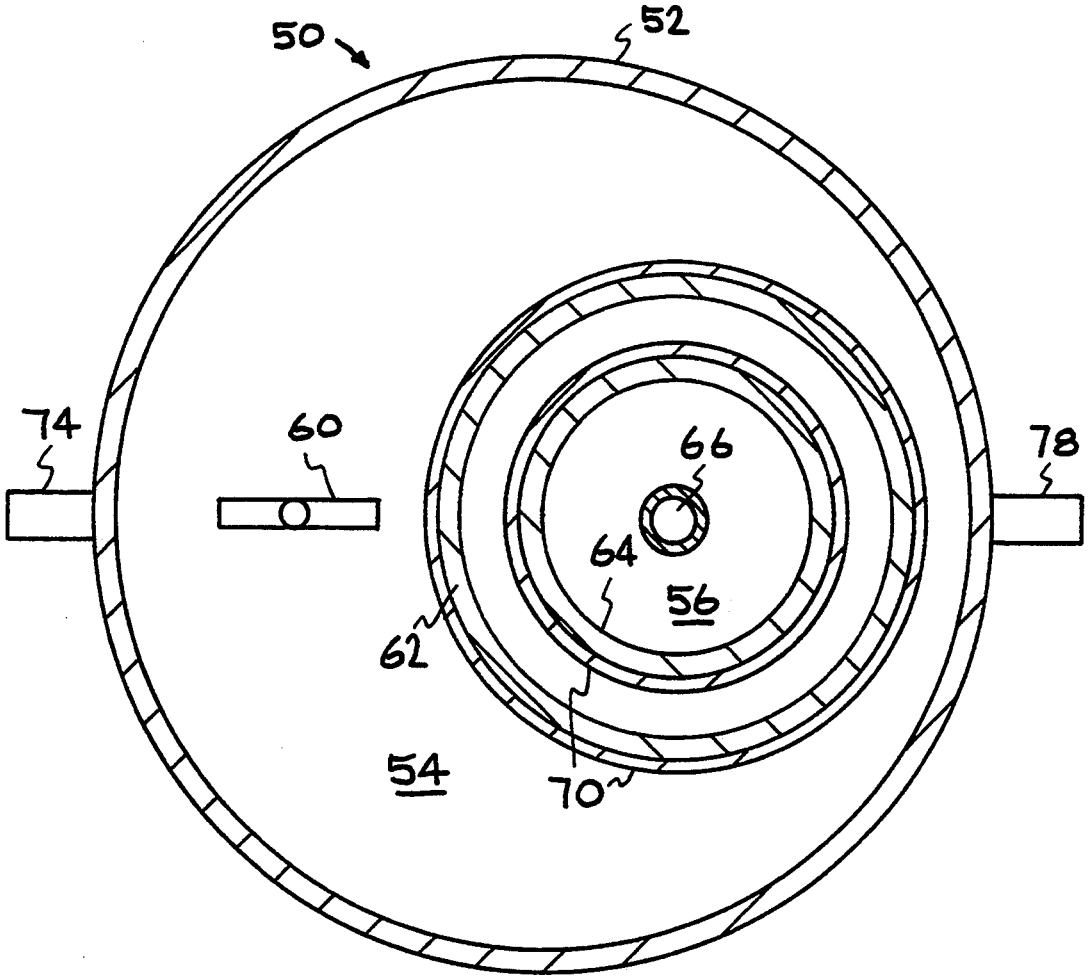
FIG. 5. A top view of the side-by-side dual zone reactor.

FIG. 4 shows a side-by-side dual zone chemical reactor 50; FIG. 5 is a top view of the reactor 50. The side-by-side reactor 50 works along the same principles as the concentric reactor (FIGS. 2 and 3). The first reaction zone 54 substantially occupies one side of the reaction vessel 52, and the second reaction zone 56 primarily occupies the other side. The starting materials or reactants are fed into the liquid carrier in the first reaction zone 54 through inlet means 58 at the top of the reactor 50. A circulating means 60 is connected to the top of the reactor 50 and extends into the first reaction zone 54.

The two reaction zones 54,56 are separated by a first cylindrical partition wall 62 and a second cylindrical partition wall 64, which both extend from the top of the reactor 50. The first wall 62 is situated between the circulating means 60 and the second partition wall 64. A gas supply means 66 is situated in the second reaction zone 56, surrounded by the second partition wall 64. The gas supply means 66 is typically a pachuca tube that injects a reactive gas into the liquid carrier near the bottom of the second reaction zone 56. The second partition wall 64 is shown in FIG. 4 extending farther into the liquid carrier than the first wall 62, fully separating the first and second reaction zones 54,56. However, as in the concentric dual zone reactor (FIGS. 2 and 3), the purpose of the partition walls 62,64 is to delineate a pathway for the liquid carrier to circulate through the first and second reaction zones 54,56, and therefore the walls 62,64 may have different lengths from those shown in FIG. 4.

The second partition wall 64 has holes 68 near the top of the second reaction zone 56 for liquid carrier to flow to the first reaction zone 54. Therefore, the reaction zones 54,56 are in open flow communication with each other at points where the chemical species in the first reaction zone 54 can meet the reactive gas in the second reaction zone 56, and where the liquid carrier generated in the second reaction zone 56 can be introduced to the first reaction zone 54. The partition walls 62,64 are typically made of magnesium oxide with a layer 70 of a resistant material, such as tantalum, on the sides facing the first reaction zone 54.

The reactants in the first reaction zone 54 are mixed by the circulating means 60 to produce a by-product and a metal product that is depicted in FIG. 4 as having descended through the liquid carrier to the bottom 72 of the vessel 52 for collection. The metal product is collected through outlet means 74 such as a weir. The liquid carrier flows downward in the first reaction zone 54, along path 80, past the second partition wall 64, to the second reaction zone 56. The by-product reacts with the reactive gas in the second reaction zone 56 from gas supply means 66. These reactions form gaseous waste products and generate in situ the liquid carrier.

The rising gas bubbles in the second reaction zone 56 drive the movement of liquid carrier upward to the top of the second reaction zone 56. Liquid carrier flows back into the first reaction zone 54 by flowing along path 82 through holes 68 in the second partition wall 64, and passing between the first and second partition walls 62,64. The liquid carrier circulates into the first reaction zone 54 for reuse in the reactor 50. The gaseous waste rises to the top of the reactor 50 and is removed through outlet means 76. Liquid carrier is continuously generated in the reactor 50, and the excess liquid is drawn off through another outlet means 78.

Heating means (not shown) outside of the vessel 52 heat the liquid carrier to the desired temperature. Insulating means (not shown) may surround the vessel 52 and the heating means. Differential heating of the vessel 52 may be advantageous to maintain liquid flow of a high-melting point metal product at the collection point.

III. Multiple Dual Zone Chemical Reactor

FIG. 6 illustrates a top view of an embodiment of a multiple dual zone reactor 100, which combines a plurality (six) of second reaction zones 102 arranged concentrically around a first reaction zone 104 located primarily in the center of the reactor 100. The multiple zone reactor 100 works on the same principles as the dual zone reactors 10,50 in FIGS. 2 and 4, and is a more efficient design for production scale processing.

FIG. 6 shows the reactor vessel 106 surrounded by heating means 110 and insulating means 112. Six (6) regeneration zones 114 are shown, each comprising a gas supply means 116 (e.g., a pachuca tube), an outer (or first) partition wall 118, and an inner (or second) partition wall 120. Each regeneration zone 114 operates like the dual zone reactor 50 in FIG. 5. The partition walls 118,120 typically have a layer 122 of tantalum metal on the side facing the first reaction zone 104. At least one circulating means 124 is located in the first reaction zone 104 in the center of the vessel 106. Outlet means 126,128 for removal of excess liquid carrier and metal product are provided. Not shown in the top view of FIG. 6 are the inlet means through which the reactants are fed into the first reaction zone 104 of the reactor 100 and the outlet means for removing gaseous waste products from the second reaction zone 102. A single set of circulating means and outlet means is shown in FIG. 6, but multiple inlet, outlet, and circulating means strategically located in a reactor will improve throughput of reactants and products.

The foregoing description of preferred embodiments of the invention has been presented for purposes of illustration and description and is not intended to be exhaustive or to limit the invention to the precise form disclosed. Many modifications and variations are possible in light of the above teaching. The scope of the invention is defined by the following claims.

It is claimed:

1. A process for continuously recovering a metal product from a metal-containing compound in a single, dual zone chemical reactor, comprising:

(a) providing a reaction vessel comprising at least two reaction zones and containing a liquid carrier, wherein a first reaction zone is partitioned from, but in fluid communication with, a second reaction zone of the vessel;

(b) introducing a metal-containing compound and a reagent into the liquid carrier in the first reaction zone of the vessel, wherein the metal-containing compound and the reagent react to produce a metal product and a by-product that is soluble in the liquid carrier;

(c) inducing continuous flow of the liquid carrier with the dissolved by-product into the second reaction zone of the vessel;

(d) introducing a reactive gas into the liquid carrier in the second reaction zone;

wherein the reactive gas and the by-product in the second reaction zone react to produce a waste gas and to generate additional liquid carrier;

(e) removing the metal product and the waste gas from the vessel; and (f) continuously circulating the liquid carrier from the second reaction zone into the first reaction zone for further use.

2. A process as recited in claim 1, wherein step (a) is carried out by:

partitioning the first and second reaction zones with at least one partition wall through which the liquid carrier is capable of flowing from one reaction zone to another.

3. A process as recited in claim 2, wherein step (f) is carried out by:

inducing upward flow of the liquid carrier in the second reaction zone and through the partition wall to the first reaction zone.

4. A process as recited in claim 1, wherein step (c) is carried out by:

inducing downward flow of the liquid carrier to the second reaction zone.

5. A process as recited in claim 1, wherein step (e) is carried out by:

collecting the metal product at a collection area at the bottom of the vessel.

6. A process as recited in claim 5, wherein step (e) is carried out by:

heating the metal product at the collection area to maintain fluidity.

7. A process as recited in claim 1, wherein the liquid carrier comprises a molten salt selected from the group consisting of alkaline earth halides and alkali metal halides.

8. A process as recited in claim 1, wherein the metal-containing compound is selected from the group consisting of metal oxides and salts.

9. A process as recited in claim 1, wherein the metal in the metal-containing compound is selected from the group consisting of actinides and rare earth metals (elements 57–72).

10. A process as recited in claim 1, wherein the reactive gas comprises a halide gas selected from the group consisting of chlorine ($Cl_2$), fluorine ($F_2$), bromine ($Br_2$), hydrogen chloride (HCl), hydrogen fluoride (HF), carbon tetrachloride ($CCl_4$), and phosgene ($COCl_2$).

11. A process as recited in claim 1, wherein the reagent comprises a metal selected from the group consisting of alkaline earth metals and alkali metals.

12. A process as recited in claim 1, wherein the metal-containing compound comprises a metal oxide, and wherein the reagent comprises a reducing agent, and wherein the by-product comprises an oxide of the reducing agent.

13. A process as recited in claim 12, wherein the metal is selected from the group consisting of actinides and rare earth metals (elements 57–72), and wherein the reducing agent comprises calcium.

* * * * *